US005613252A

United States Patent [19]

Yu et al.

[11] Patent Number: 5,613,252

[45] Date of Patent: Mar. 25, 1997

[54] MULTIPURPOSE SICKBED

[76] Inventors: Cheng-Nan Yu, No. 128, Chung Cheng Rd., Chu-Tung Town, Hsin Chu Hsien; Chin-Jun Wu, 5F, No. 7, Lane 118, Sec. 2, Chung Cheng Rd., Shi-Lin District, Taipei, both of Taiwan

[21] Appl. No.: 514,999

[22] Filed: Aug. 14, 1995

[30] Foreign Application Priority Data

Aug. 12, 1994 [CN] China ..... ZL 94 218346.0

[51] Int. Cl.[6] ..... A61G 7/008; A61G 7/16

[52] U.S. Cl. ..... 5/88.1; 5/600; 5/609; 5/617; 5/933

[58] Field of Search ..... 5/88.1, 600, 607, 5/609, 613, 617, 915, 933, 934, 618

[56] References Cited

U.S. PATENT DOCUMENTS 4,222,131 9/1980 Holdt et al. ..... 5/617

4,225,988 10/1980 Cary et al. ..... 5/617

5,392,479 2/1995 Liao ..... 5/607

FOREIGN PATENT DOCUMENTS 0539660 2/1957 Italy ..... 5/617

*Primary Examiner*—Steven N. Meyers

*Assistant Examiner*—Robert G. Santos

[57] ABSTRACT

A multipurpose sickbed including a body turning-over mechanism, which includes a sheet-like bearing element upon which the sick person lies, and two revolving shafts connected to the sheet-like bearing element at two opposite sides and alternatively controlled to take up the sheet-like bearing element in turning over the body of the sick person, a sit-up mechanism controlled to turn a head plate and a back plate in helping the sick person to sit up, and a massaging mechanism controlled to reciprocate a transverse rod under the sheet-like bearing element in massaging the back of the sick person.

5 Claims, 17 Drawing Sheets

MULTIPURPOSE SICKBED

BACKGROUND OF THE INVENTION

The present invention relates to sickbeds, and relates more particularly to a multipurpose sickbed which can be conveniently operated to turn over the body of the sick person leftward or rightward, to help the sick person sit up, and to massage the back of the sick person.

Taking care a sick person who lies on the bed and cannot move the body by himself, is not an easy job. For example, when to take care a vegetable or a sick person who suffers from a stroke of paralysis or apoplexy, the body of the patient must be regularly turned over and massaged about once per two hours. However, a nurse cannot do this job without the assistant of other persons. Various sickbeds have been developed for sick persons. These sickbeds commonly have a folding bed plate which consists of two longitudinal plates hinged together. When one longitudinal plate is turned upwards, the upper part or lower part of the sick person is lifted. However, when the folding bed plate is driven to help the sick person sit up, the sick person tends to slip downwards along the lifted longitudinal plate of the folding bed plate.

SUMMARY OF THE INVENTION

The present invention has been accomplished to provide a multipurpose sickbed which eliminates the aforesaid problem. It is one object of the present invention to provide a multipurpose sickbed which can be operated to turn over the body of the sick person leftward or rightward within 70°–90°. It is another object of the present invention to provide a multipurpose sickbed which can be operated to help the sick person sit up and to hold the sick person in the sit-up position. It is still another object of the present invention to provide a multipurpose sickbed which has a massaging mechanism controlled to massage the back of the sick person.

According to the preferred embodiment of the present invention, the multipurpose sickbed comprises a body turning-over mechanism for turning over the body of the sick person, a sit-up mechanism for helping the sick person to sit up in the bed, and a massaging mechanism for massaging the back of the sick person. The body turning-over mechanism comprises a sheet-like bearing element upon which the sick person lies, and two parallel revolving shafts connected to the sheet-like bearing element at two opposite sides and alternatively controlled to take up the sheet-like bearing element in turning over the body of the sick person. The sit-up mechanism comprises a head plate for supporting the head of the sick person, a back plate hinged to the head plate for supporting the back of the sick person, a foot plate fixedly secured to the bedstead for supporting the legs of the sick person, and a driving mechanism controlled to lift the head plate and the back plate in helping the sick person to sit up. The massaging mechanism comprises a driving mechanism, and a transverse rod reciprocated by the driving mechanism under the sheet-like bearing element to massage the back of the sick person.

DETAILED DESCRIPTION OF THE PREFERRED EMBODIMENT

A multipurpose sickbed in accordance with the present invention is generally comprised of a body turning-over mechanism controlled to turn over the body of the sick person, a sit-up mechanism controlled to help the sick person sit up, and a massaging mechanism controlled to massage the back of the sick person.

Figure 1:
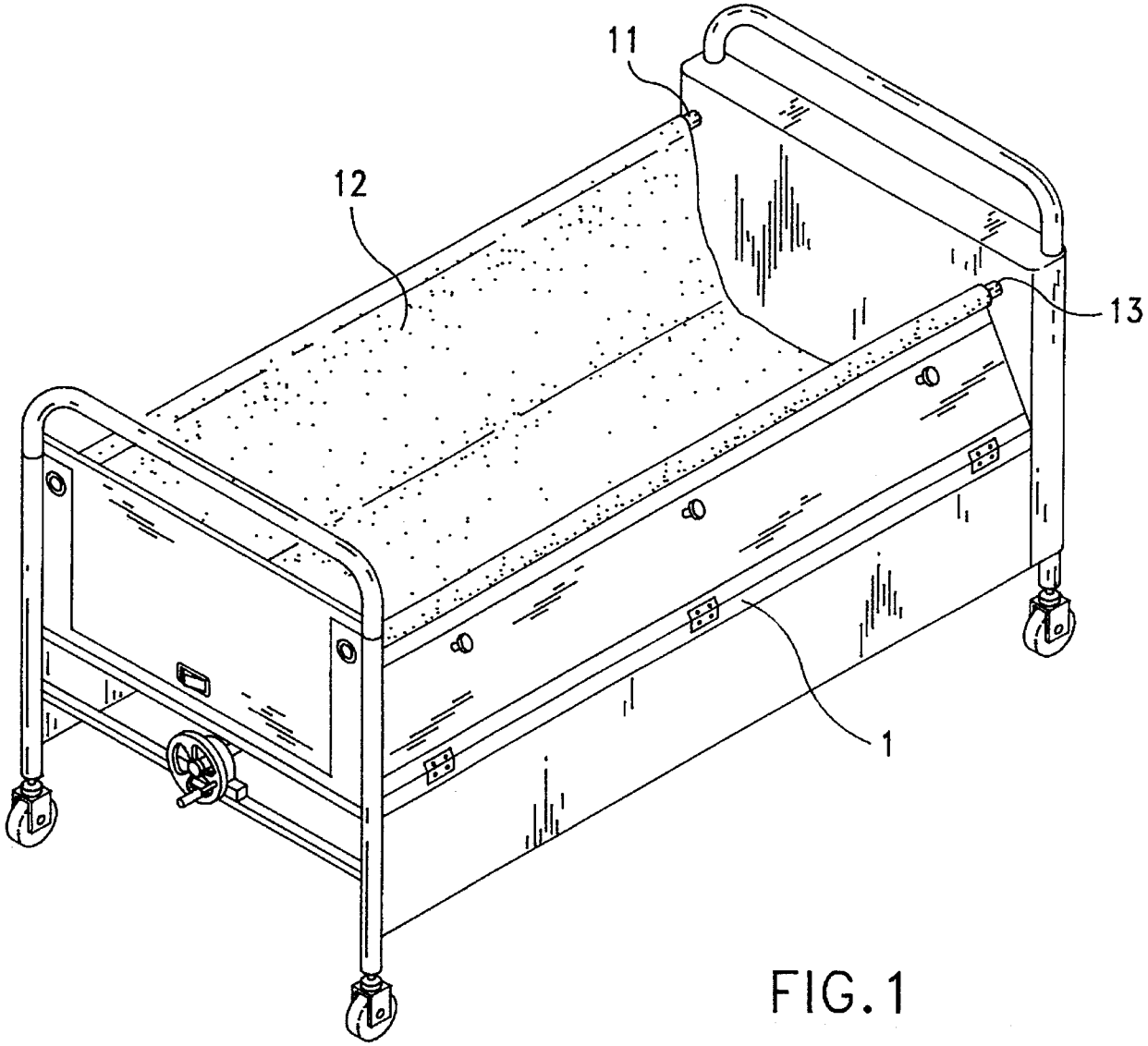
FIG. 1 is an elevational view of a multipurpose sickbed according to the present invention.

The body turning-over mechanism is outlined hereinafter with reference to FIG. 1. As illustrated in FIG. 1, a left revolving shaft 11 and a right revolving shaft 13 are longitudinally mounted at two opposite sides of the bedstead 1, and a sheet-like bearing element 12 is connected between the left revolving shaft 11 and the right revolving shaft 13. When the left revolving shaft 11 and the right revolving shaft 13 are synchronously turned in the same direction, the sheet-like bearing element 12 upon which a sick person lies is moved to turn the body of the sick person leftward or rightward through a certain angle.

Figure 2:
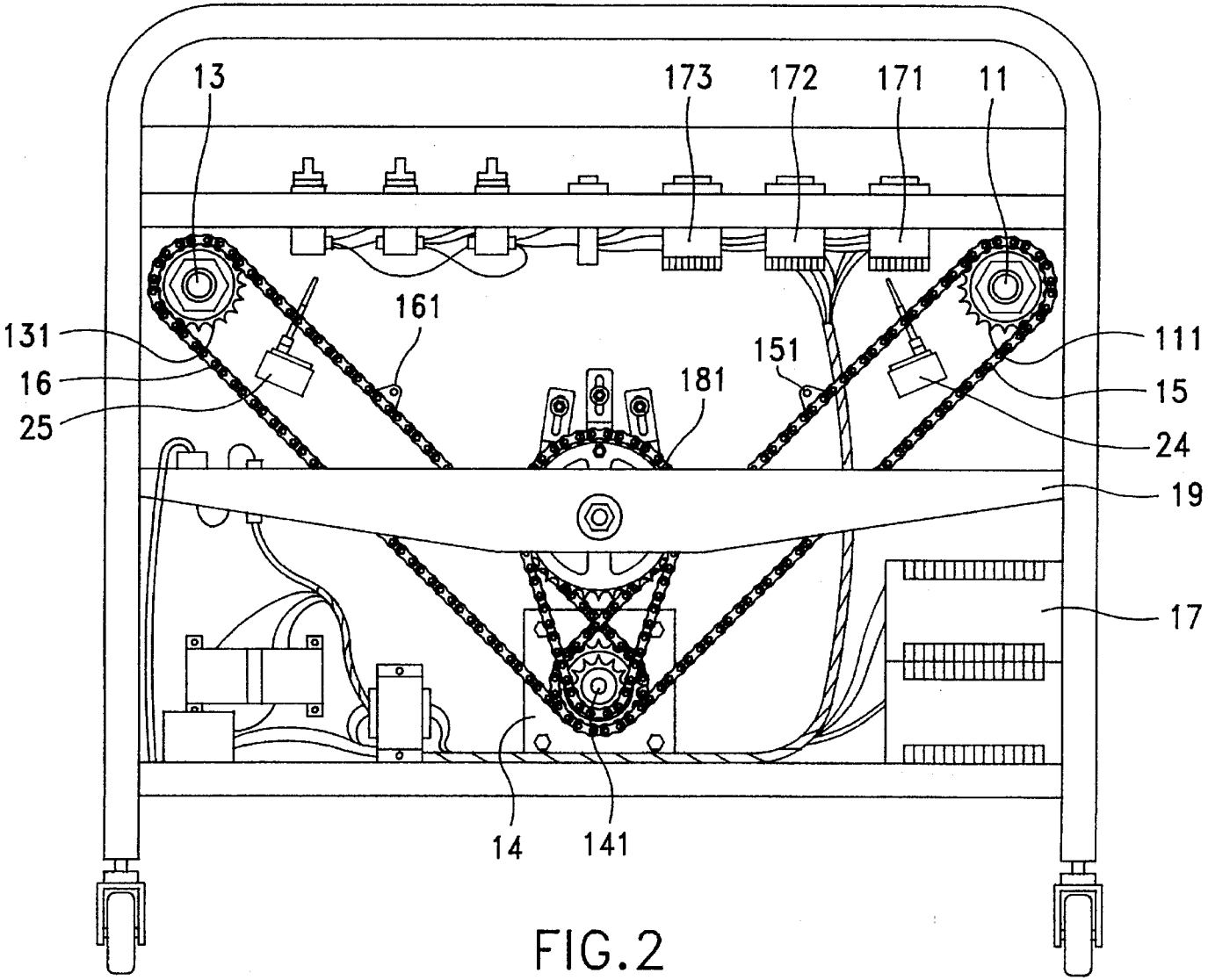
FIG. 2 is a rear side view in plain of the body turning-over mechanism according to the present invention.

Referring to FIGS. 2 and, 3, a left chain wheel 111 and a right chain wheel 131 are respectively and fixedly mounted on the left revolving shaft 11 and the right revolving shaft 13 at one end. A reversible motor 14 is mounted in the bedstead 1 at the bottom near the head of the bed. Three chain wheels, namely, the first chain wheel 142, the second chain wheel 143, and the third chain wheel 144 are fixedly mounted around the output shaft 141 of the reversible reversible motor 14. A left chain 15 is mounted around the second chain wheel 143 and the left chain wheel 111. A right chain 16 is mounted around the third chain wheel 144 and the right chain wheel 131. Therefore, when the reversible motor 14 is turned on, the left revolving shaft 11 and the right revolving shaft 13 are synchronously turned in the same direction. There are provided a programmable controller 17, a first timer 171, a second timer 172, and a third timer 173 for controlling the operation of the reversible motor 14. A detecting chain wheel 18 is mounted on a cross bar 19 of the bedstead 1 at the head of the bed. A coupling chain 181 is mounted around the detecting chain wheel 18 and the first chain wheel 142 of the output shaft 141 of the reversible motor 14. The detecting chain wheel 18 comprises a pin 20 perpendicularly disposed at one side. There are three sensors, namely, the first sensor 21, the second sensor 22, and the third sensor 23 installed in the path of the pin 20 at different locations and respectively connected to the programmable controller 17. The sensors 21, 22, and 23 detect the position of the pin 20, and send the detected information to the programmable controller 17.

Figure 3:
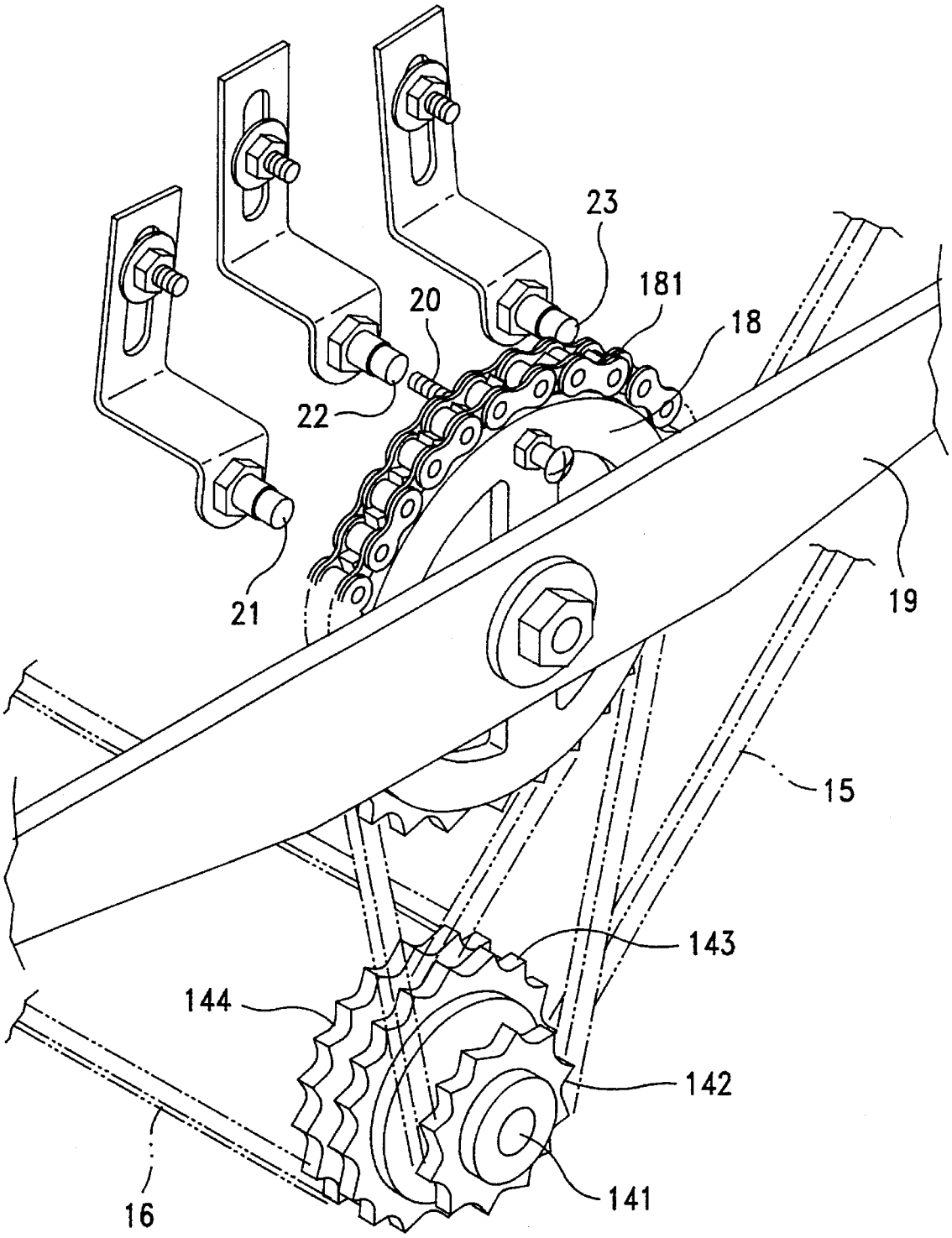
FIG. 3 is a partial view of the body turning-over mechanism, showing the installation of the chain wheels, chains, and sensors.
Figure 5:
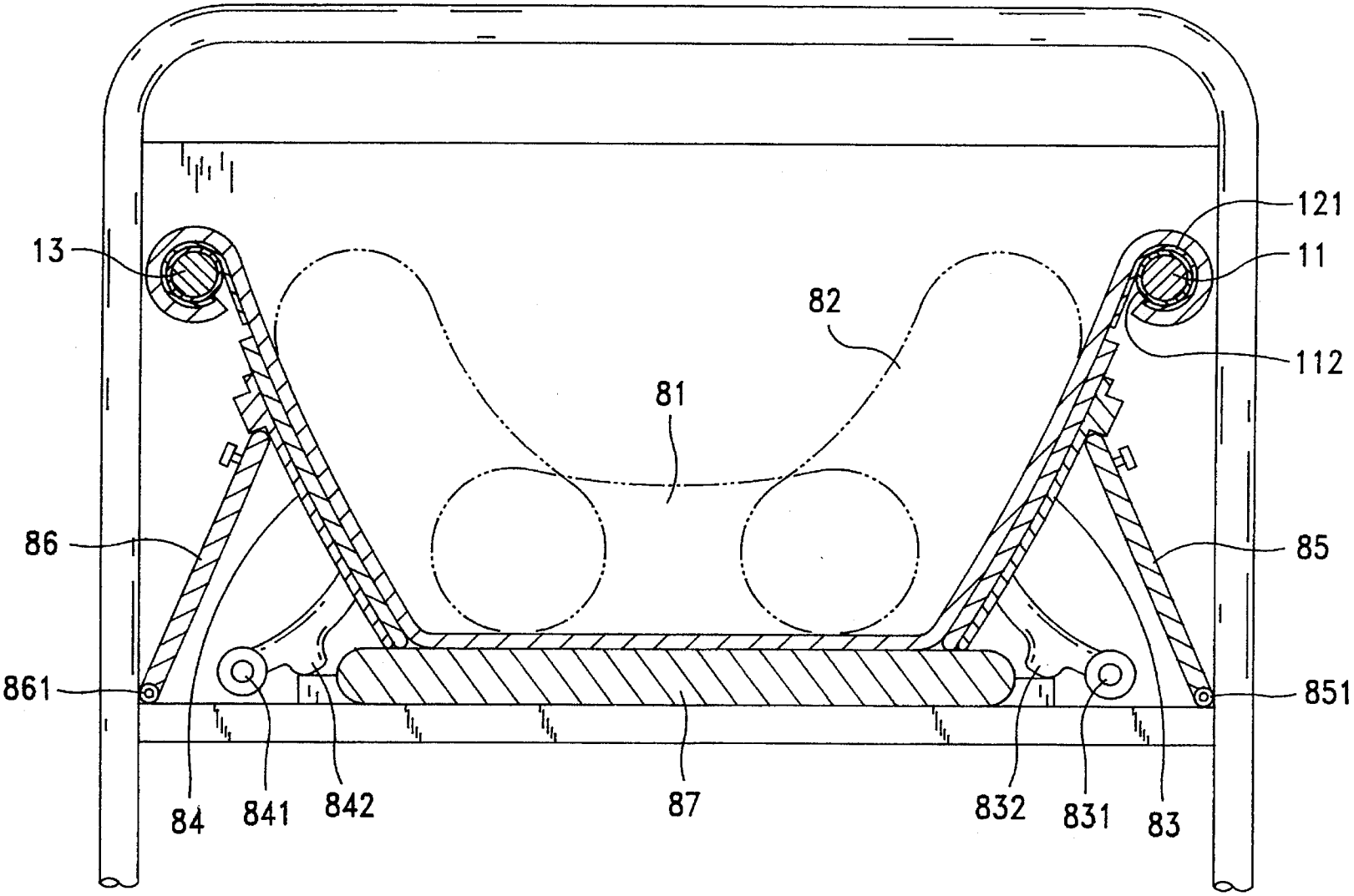
FIG. 5 is a sectional view of the body turning-over mechanism according to the present invention.

Referring to FIG. 5 and FIG. 3 again, when the output shaft 141 of the reversible motor 14 is rotated clockwise, all chain wheels and chains as well as the the revolving shafts 11 and 13 are turned clockwise, therefore the sheet-like bearing element 12 is taken up by the left revolving shaft 11. At the same time, the pin 20 is gradually moved toward the second sensor 22. When the position of the pin 20 is detected by the second sensor 22, the second sensor 22 immediately gives a signal to the programmable controller 17, causing it to stop the reversible motor 14. At this stage, the body of the sick person is rested at full length on the sheet-like bearing element 12 in the middle position 81. The length of time in which the body of the sick person is rested on the sheet-like bearing element 12 in the middle position 81 is determined subject to the setting of the second timer 172. When the pin 20 is moved to the third sensor 23, the left revolving shaft 11 keeps taking up the sheet-like bearing element 12. When the third sensor 23 detects the position of the pin 20, the reversible motor 14 is stopped, and the body of the sick person is moved to the left side position 82 and transversely tilted. The length of time in which the body of the sick person is rested on the sheet-like bearing element 12 in the left side position 81 is determined subject to the setting of the third timer 173. When the set time of the third timer 173 is up, the reversible motor 14 is turned in the reversed direction, causing the right revolving shaft 13 to take up the sheet-like bearing element 12. In actual practice, when the sheet-like bearing element 12 is moved to the middle position, the section of the sheet-like bearing element 12 between the body of the sick person and the take-up revolving shaft 11 or 13 will be stretched, causing the sick person feels uncomfortable. This problem can be eliminated by continuously turning the take-up revolving shaft 11 or 13 through a small angle after the pin 20 is detected, and then turning the take-up revolving shaft 11 or 13 reversely through a small angle to release the stretched section of the sheet-like bearing element 12.

Figure 6:
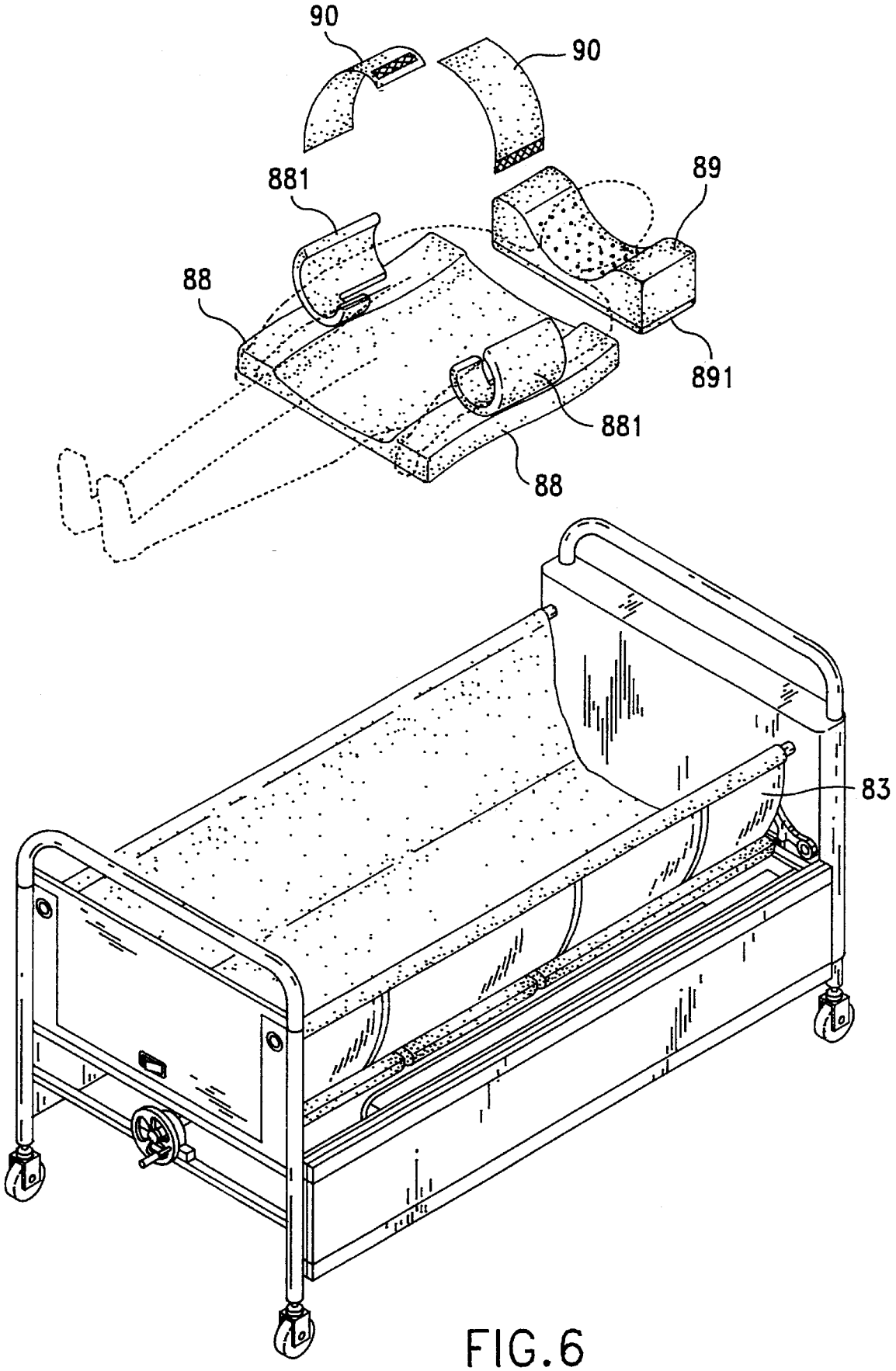
FIG. 6 is an exploded view of the hand guard cushions, the pillows, and the waist straps according to the present invention.

Referring to FIGS. 5 and 6, a left guide plate 83 and a right guide plate 84 are longitudinally and bilaterally mounted in the bedstead 1 to support the sheet-like bearing element 12 and to guide its movement, each guide plate 83 or 84 having a back frame 832 or 842 turned about a respective pivot 831 or 841 in the bedstead 1. A left supporting plate 85 and a right supporting plate 86 are bilaterally mounted in the bedstead 1 to support the guide plate 83 and 84, each supporting plate 85 or 86 having one end turned about a respective pivot 851 or 861.

Figure 4:
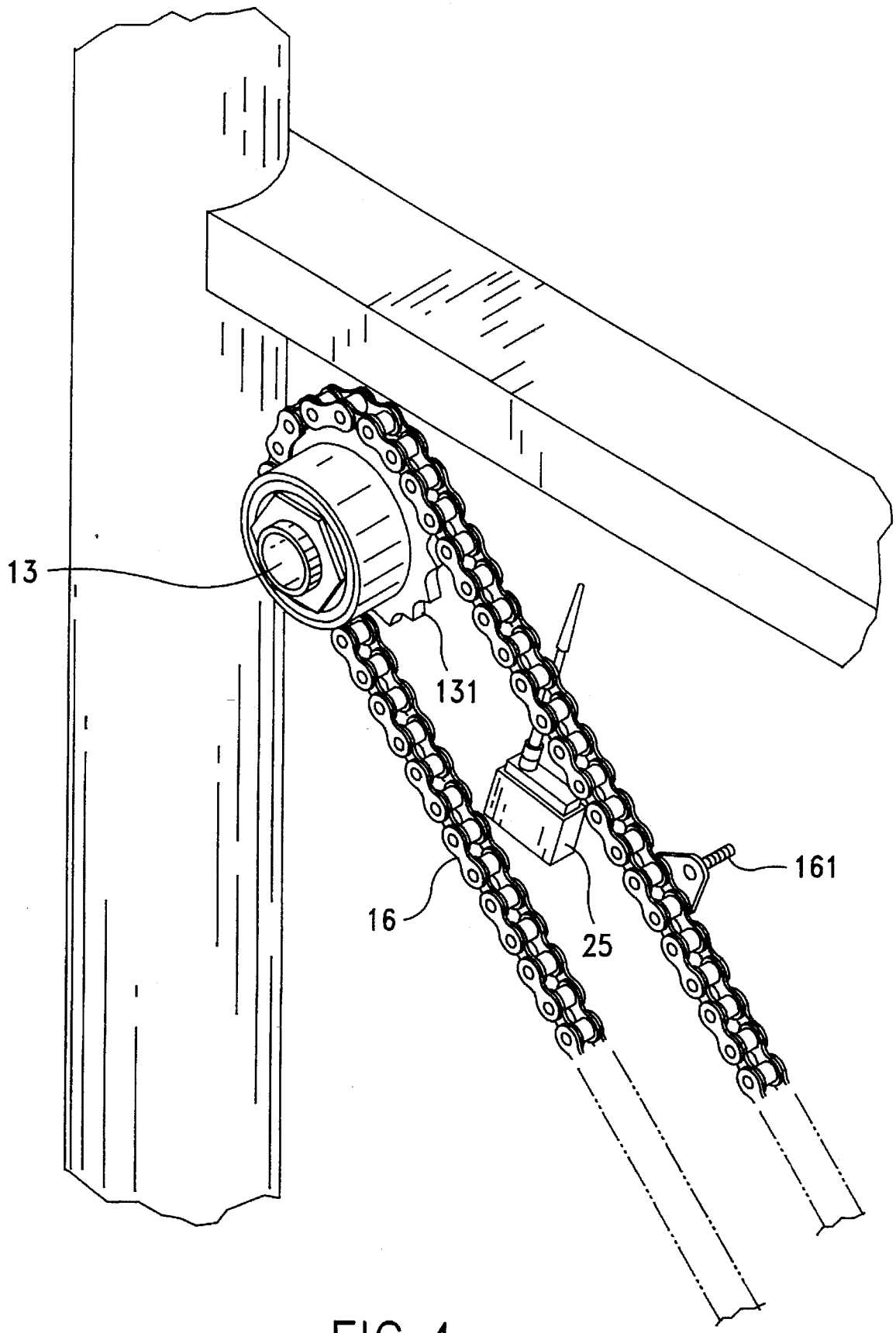
FIG. 4 is another partial view of the body turning-over mechanism, showing the position of the right micro-switch relative to the respective chain.

Referring to FIGS. 2 and 4, a left micro-switch 24 and a right micro-switch 25 are respectively mounted in the bedstead 1 near one end of each chain 15, 16. A left pin 151 and a right pin 161 are respectively fixed to the left chain 15 and the right chain 16. When the programmable controller 17 is working properly, the pin 151 or 161 will move with the respective chain 15 or 16 between the respective micro-switch 24 or 25 and the motor 14, and not the trigger the respective micro-switch 24 or 25. But when the programmable controller 17 fails to work properly, the pin 151 or 161 will trigger the respective micro-switch 24 or 25 to stop the reversible motor 14 after the revolving shaft 11 or 13 passes over the maximum tolerable angle.

Referring to FIGS. 5 and 6, an air permeable mattress 87 is mounted on the bedstead 1 under the sheet-like bearing element 12. Of course an additional air-permeable mattress can also be covered on the top side of the sheet-like bearing element 12 if desired. Hand guard cushions 88 are mounted on the sheet-like bearing element 12, each defining a longitudinal groove 881 for supporting the hands of the sick person. A pillow 89 is mounted on the sheet-like bearing element 12 for supporting the head of the sick person. A hard plate element 891 is put under (or within) the pillow 89 to prevent it from being bent when the body of the sick person is transversely tilted. The pillow 89 and the hand guard cushions 88 are preferably made having raised portions so that a satisfactory ventilation of air can be maintained when the head and hands of the sick person are respectively supported thereon. The connection between the sheet-like bearing element 12 and the revolving shafts 11 and 13 can be made by loop and hook materials. For example, the left revolving shaft 11 is fixedly mounted with a loop tape 112, and the corresponding end of the sheet-like bearing element 12 is fixedly mounted with a hook tape 121 for fastening to the loop tape 112 of the left revolving shaft 11. The hand guard cushions 88 and the pillow 89 can also be fastened to the sheet-like bearing element 12 (or the air-permeable mattress on the sheet-like bearing element 12) by hook and loop materials. Two waist straps 90 are respectively fastened to the hand guard cushions 88 for fastening to the waist of the sick person to fix it in place and to keep the waist warm.

Figure 7:
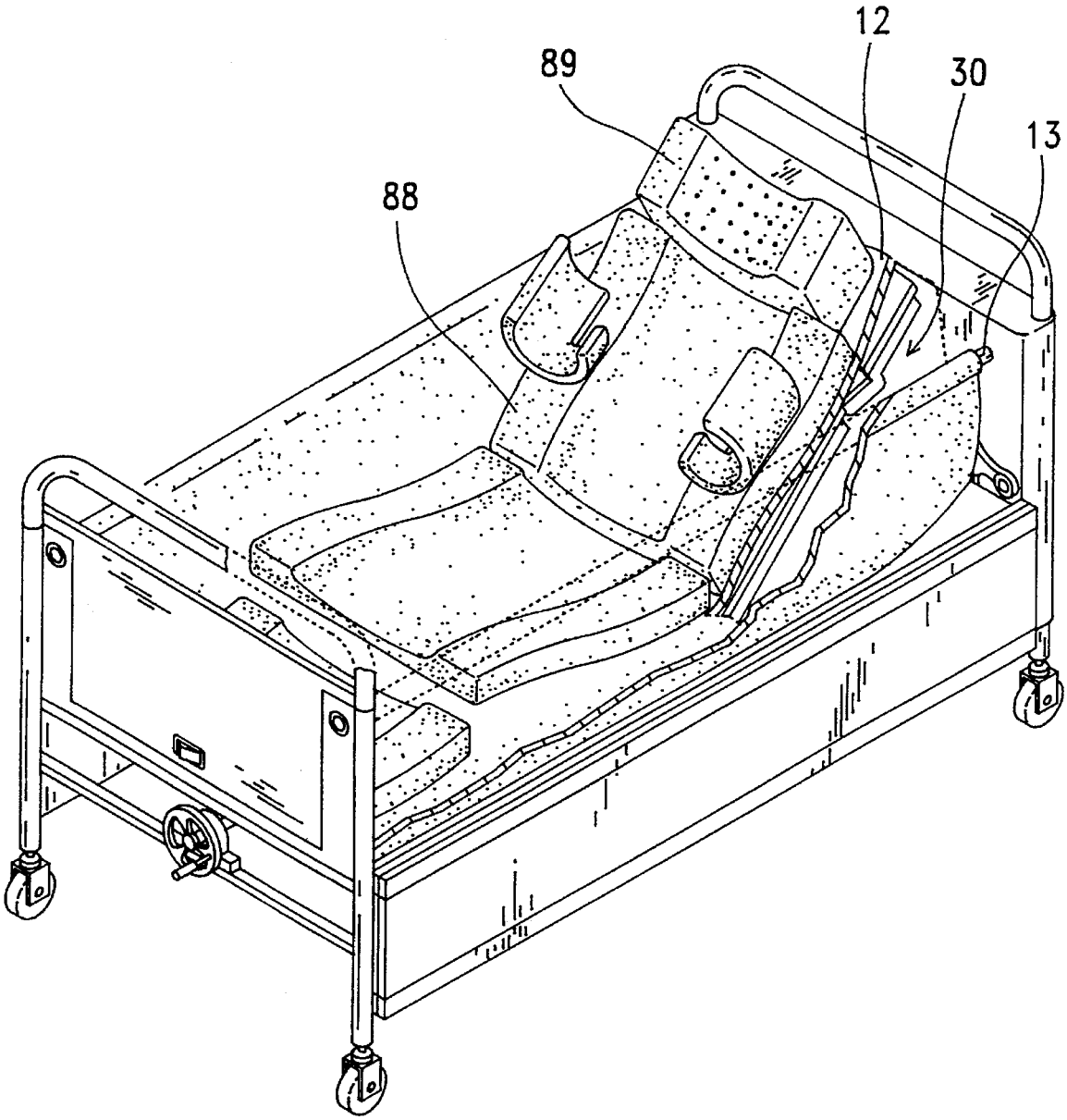
FIG. 7 is a perspective view showing the sit-up mechanism moved to the working position according to the present invention.
Figure 8:
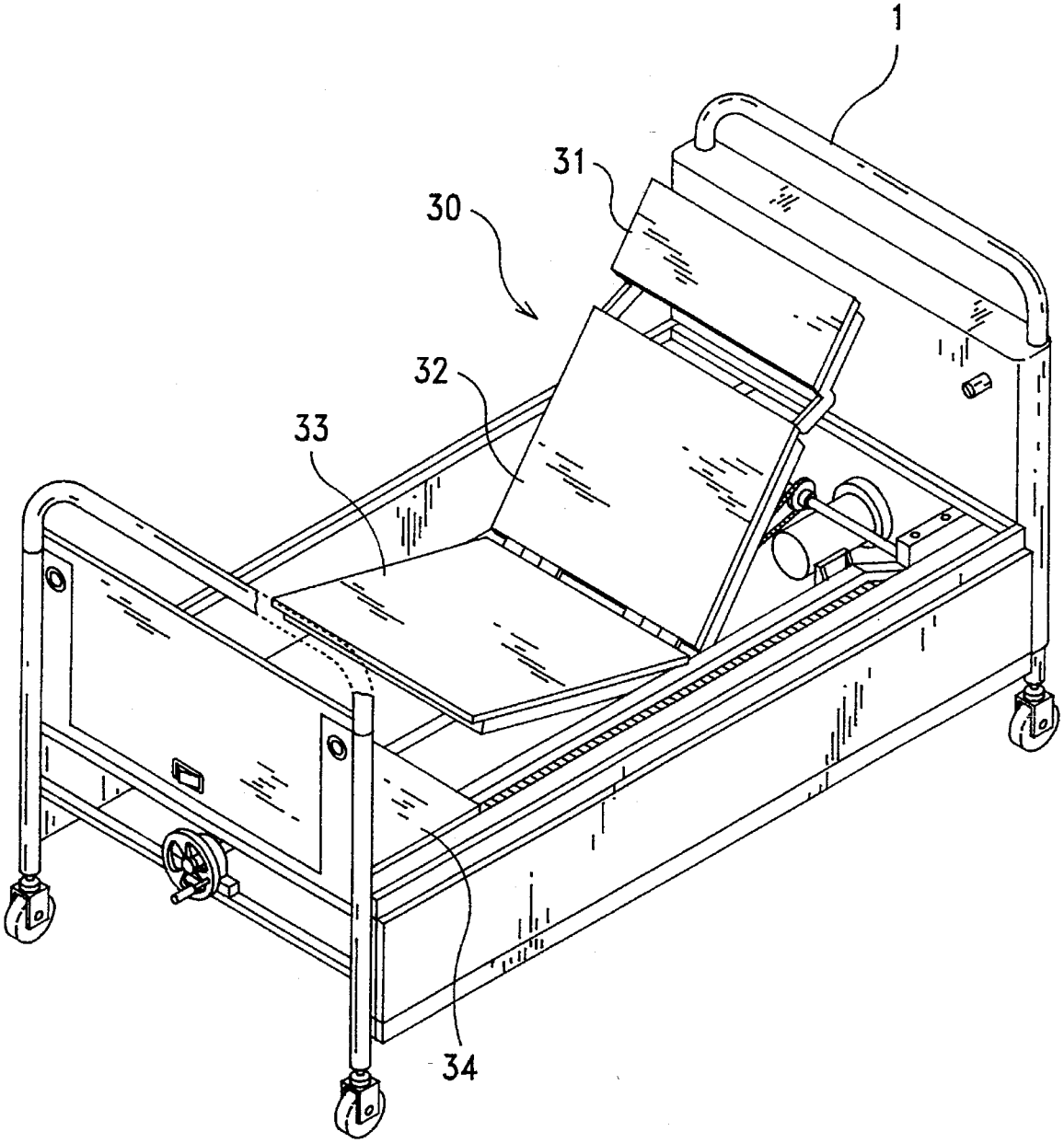
FIG. 8 shows the sit-up mechanism installed in the bedstead, the hand guard cushions and the pillow removed from the sit-up mechanism according to the present invention.
Figure 9:
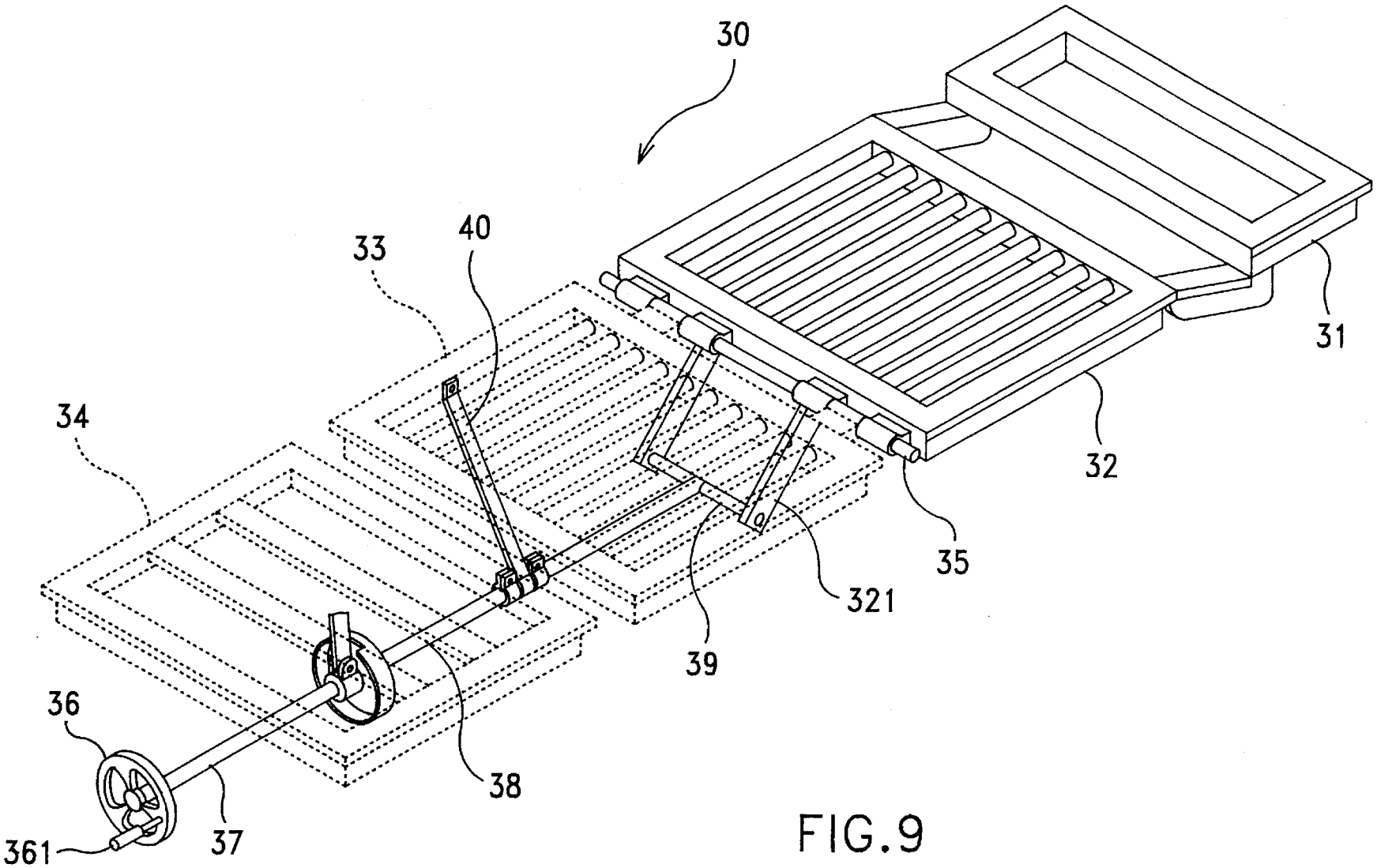
FIG. 9 is a perspective of the bed plate of the sit-up mechanism according to the present invention.

Referring to FIGS. 7, 8, and 9, a sit-up mechanism is provided to help the sick person sit up in the bed from a laying position. FIG. 8 shows the structure of the sit-up mechanism when the hand guard cushions 88 and the pillow 89 are removed. The sit-up mechanism comprises a bed plate 30 mounted on the bedstead 1. The bed plate 30 is comprised of a head plate 31, a back plate 32, a bottom plate 33, and a foot plate 34. The head plate 31 and the back plate 32 are fixedly and longitudinally connected together. The bottom plate 33 and the back plate 32 are respectively turned about a pivot 35. Therefore, the bottom plate 33 and the back plate 32 can be turned relative to each other. The foot plate 34 is fixedly mounted on the bedstead 1. The sit-up mechanism further comprises a hand wheel 36, a driving rod 37, a driven rod 38, a coupling rod 39, and two connecting rods 40. The hand wheel 36 comprises a handle 361 for turning by hand. The driving rod 37 has one end fixedly connected to the center of the hand wheel 36, and an opposite end fastened to one end of the driven rod 38. The driven rod 38 has an outer thread 381 at one end threaded into an inner thread (not shown) on the driving rod 37, and an opposite end perpendicularly connected to the coupling rod 39. The coupling rod 39 has two opposite ends connected between two parallel rods 321, which extend from the back plate 32 adjacent to the pivot 35. The connecting rods 40 are pivotably connected between the driven rod 38 and two opposite sides of the bottom plate 33.

Figure 10:
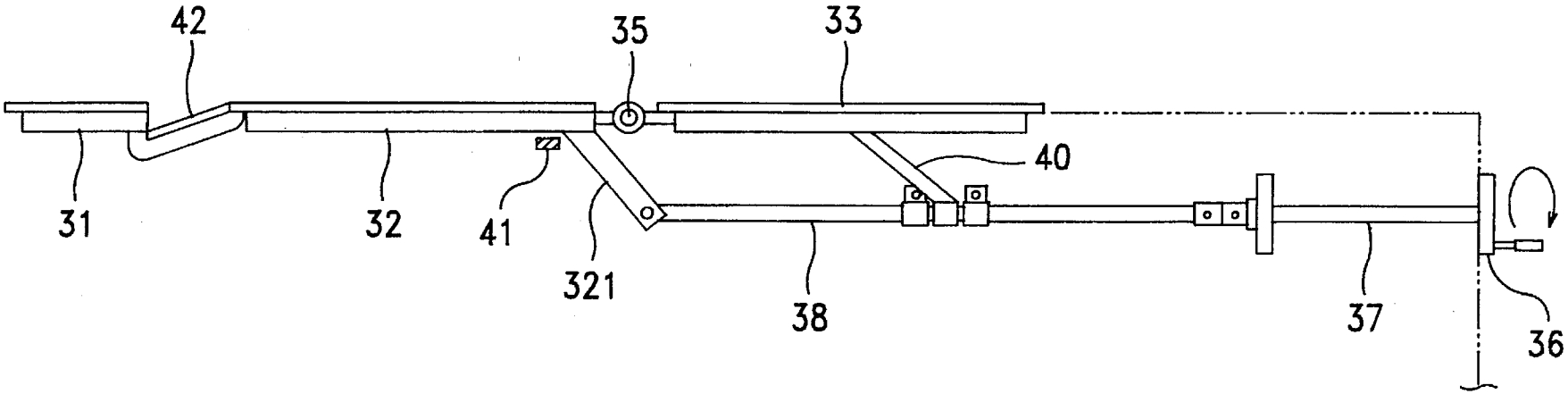
FIG. 10 is a side plain view showing the sit-up mechanism moved to the horizontal position according to the present invention.
Figure 11:
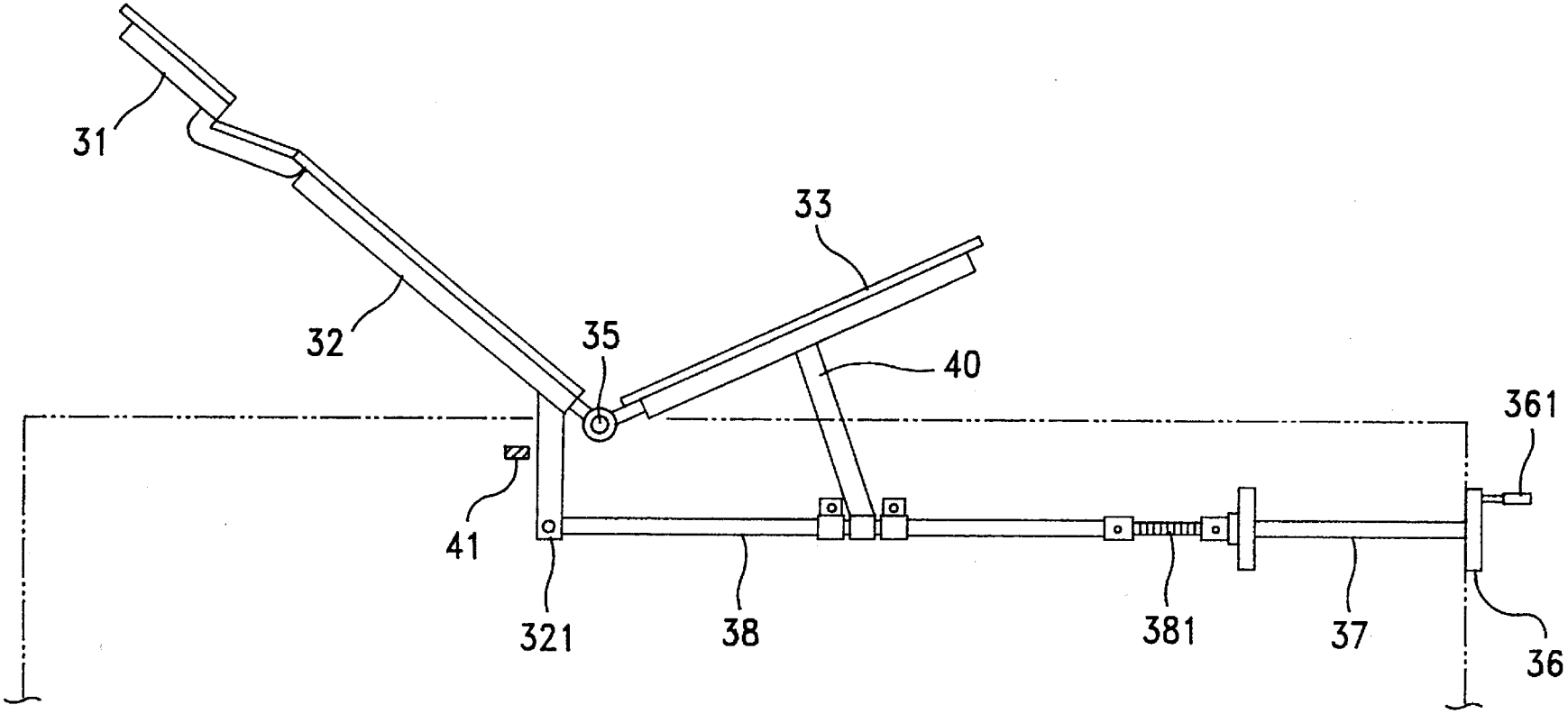
FIG. 11 shows the sit-up mechanism moved to the working position according to the present invention.

Referring to FIGS. 10 and 11, when the hand wheel 36 is turned in one direction to rotate the driving rod 37, the driven rod 38 is forced by the driving rod 37 to move toward the head plate Because the back plate 32 and the bottom plate 33 are respectively turned about the pivot 35 and the parallel rods 321 of the back plate 32 are connected to the driven rod 38 through the coupling rod 39, moving the driven rod 38 forwards toward the head plate 31 causes the back plate 32 to tilt upwards. At the same time, the rear side of the bottom plate 33 remote from the pivot 35 is lifted by the connecting rods 40 to a certain height.

Figure 12:
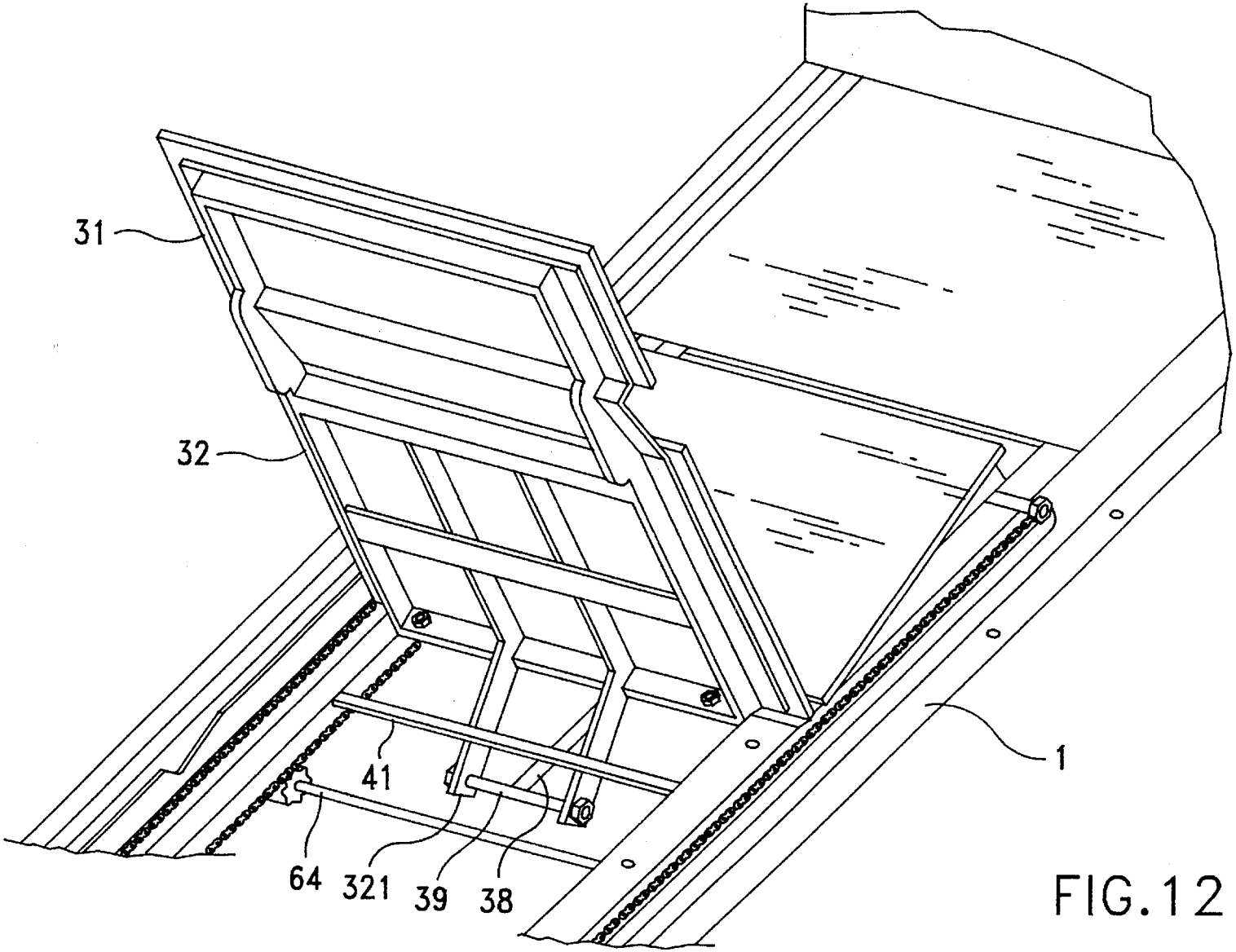
FIG. 12 shows the installation of the transverse stop plate of the sit-up mechanism in the bedstead according to the present invention.
Figure 13:
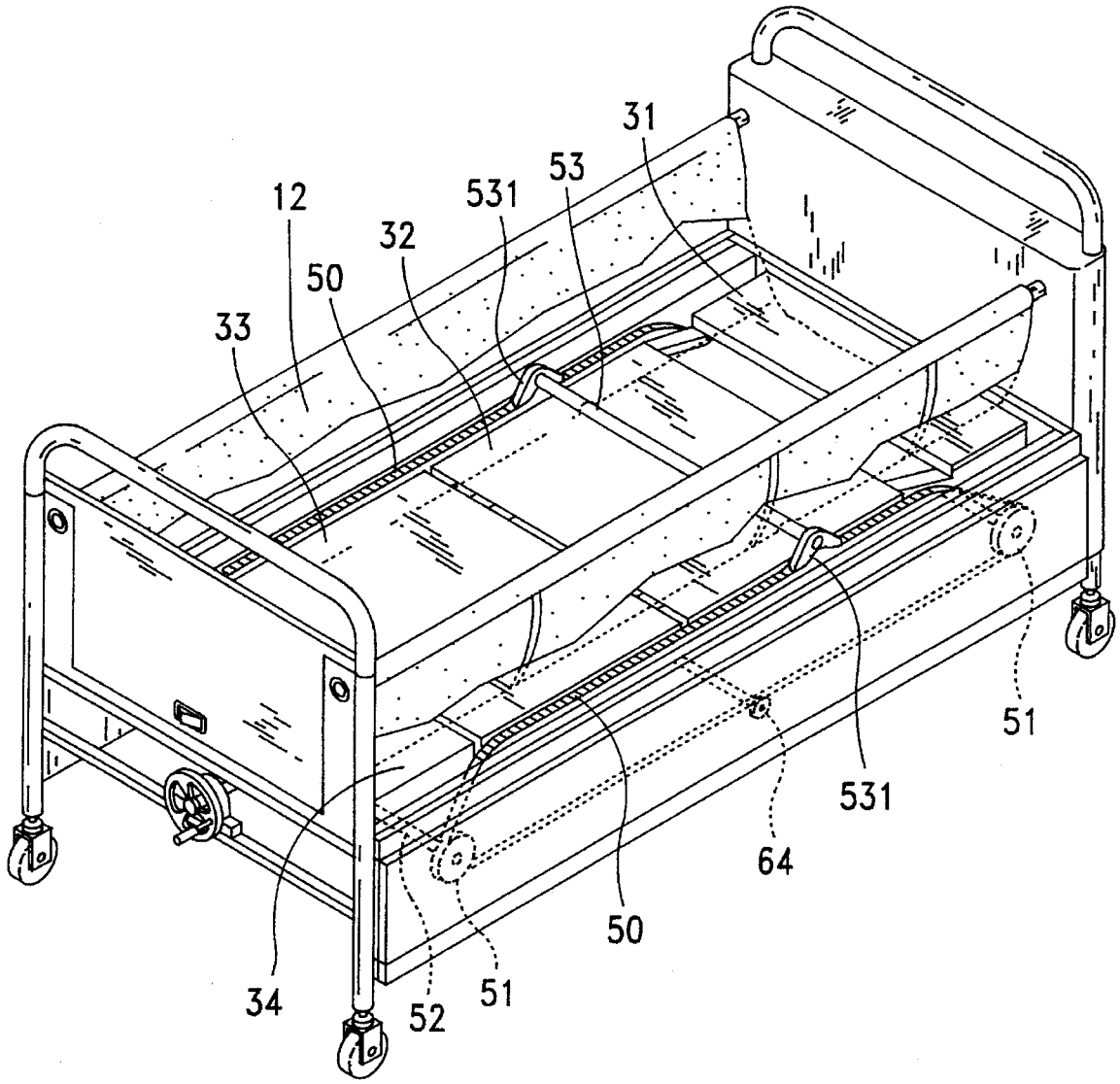
FIG. 13 is a perspective view of the multipurpose sickbed showing the installation of the massaging mechanism according to the present invention.
Figure 14:
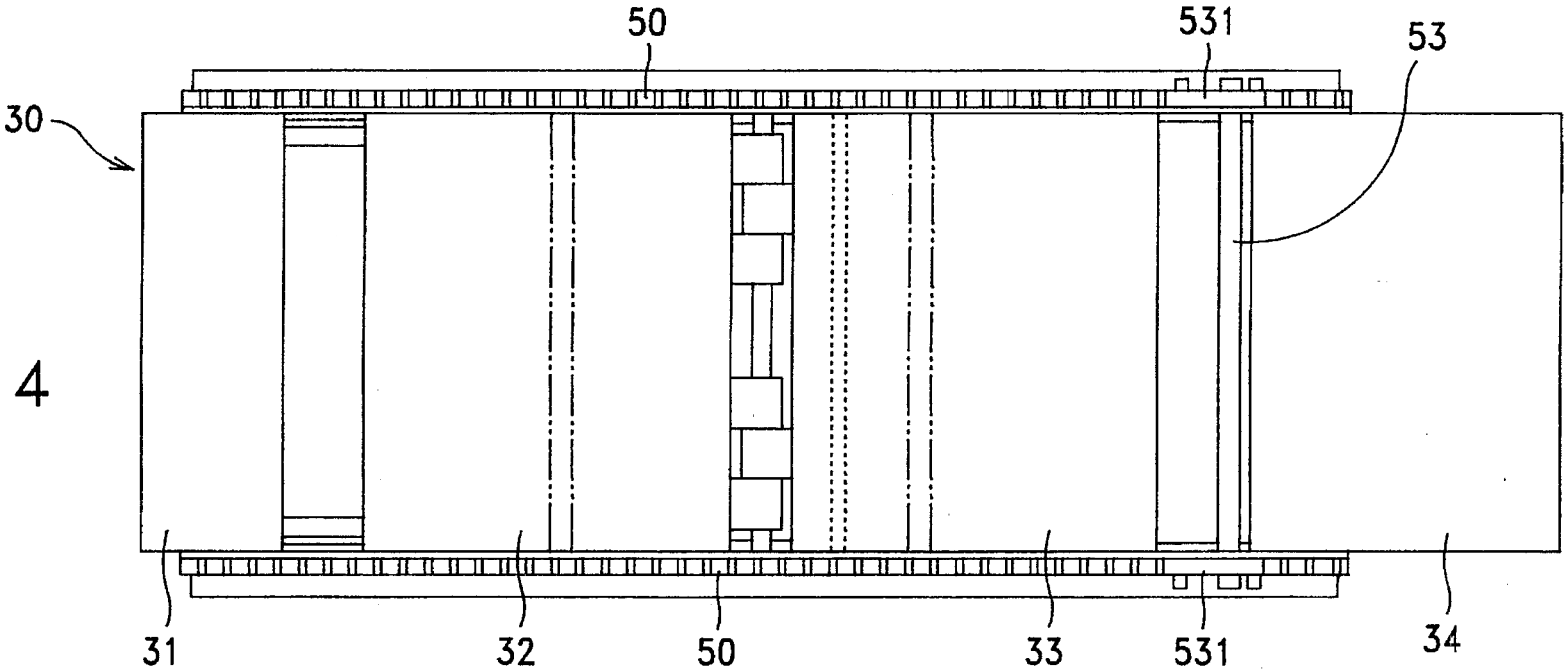
FIG. 14 is a top view showing the installation of the massaging mechanism in the bed plate according to the present invention.

Referring to FIG. 12, a transverse stop plate 41 is provided to limit the turning angle of the back plate 32. Referring to FIG. 7 again, when the sit-up mechanism moved to working position, the turning-over mechanism would not work as efficiently since the movement of the sheet-like element is not being fully supported by guide plates 83 and 84. The turning over mechanism would work at maximum efficiency when the bed plate 30 is moved to the horizontal position.

Referring to FIGS. 13, 14, 15, and 16, the sick bed is further equipped with a massaging mechanism, which is workable only when the bed plate 30 is moved to the horizontal position. The massaging mechanism comprises two pairs of transmission chain wheels 51 at two opposite sides of the bedstead 1, two transmission chains 50 respectively mounted around the transmission chain wheels 51, a transmission shaft 52 coupled between the two pairs of transmission chain wheels 51, a tension adjustment chain wheel 64, a transverse rod 53 mounted on the bed plate 30 and having two connectors 531 at two opposite ends respectively connected to the pair of transmission chains 50. When the transmission chain wheels 51 are rotated, the transverse rod 53 is moved between the opening 42 between the head plate 31 and the back plate 32, and the gap between the bottom plate 33 and the foot plate 34. The massaging mechanism further comprises a master transmission chain wheel 54 fixedly mounted around the transmission shaft 52, a power drive 56, a driving chain wheel 57 turned by the power drive 56, a driving chain 55 mounted around the driving chain wheel 57 and the master transmission chain wheel 54, and a control device 61 for controlling the forward/backward rotation of the power drive 56.

Figure 15:
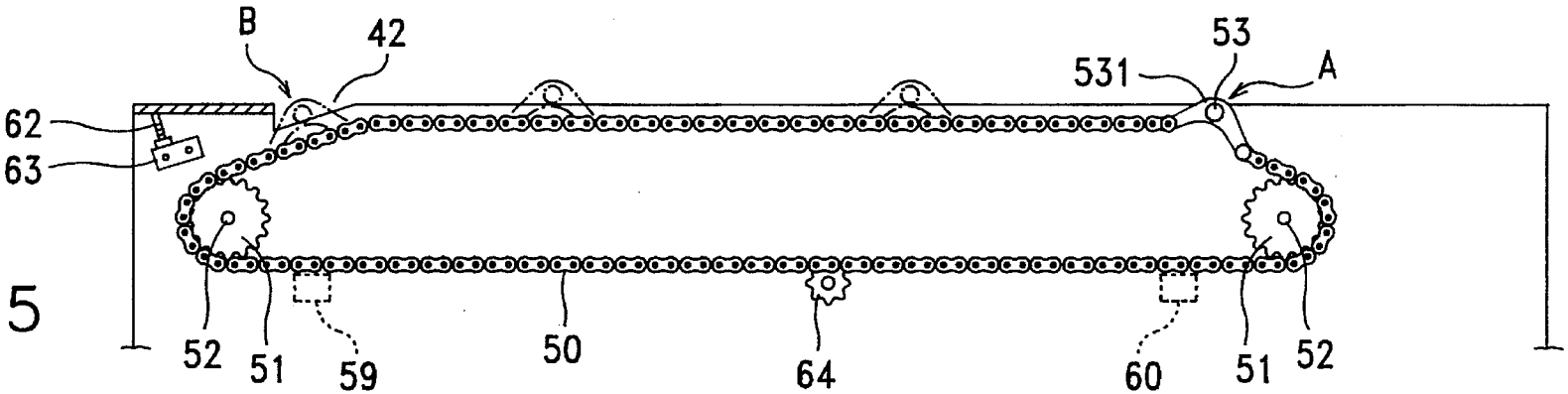
FIG. 15 is a side view showing the installation of the massaging mechanism in the bed plate according to the present invention.
Figure 16:
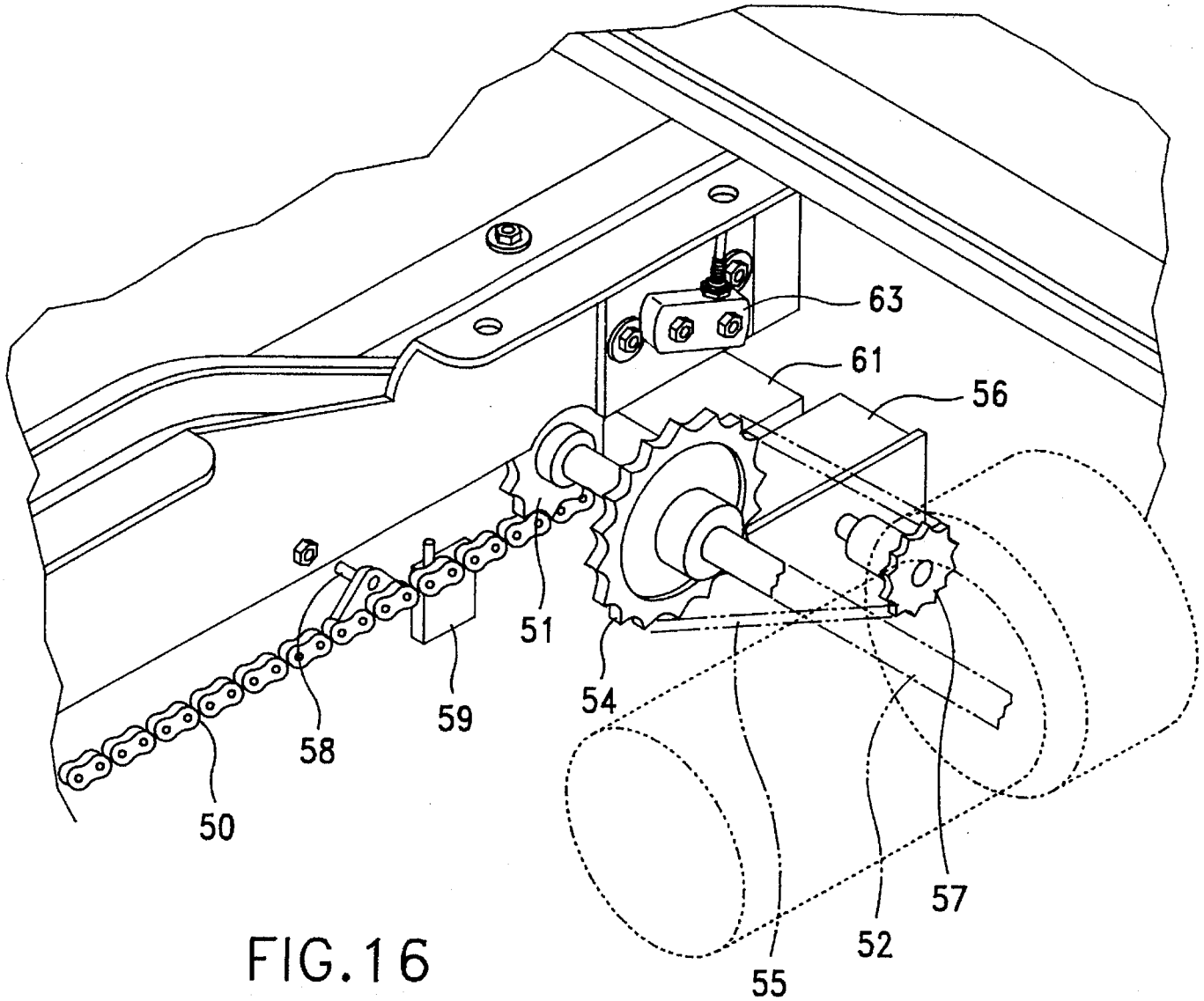
FIG. 16 is a perspective view of the transmission mechanism of the massaging mechanism according to the present invention.

Referring to FIGS. 15 and 16, a pin 58 is fastened to the transmission chain 50 at the bottom side. A front sensor 59 and a rear sensor 60 are mounted in the bedstead at one side near two opposite ends to detect the movement of the pin 58. When the transverse rod 53 is moved to position A between the bottom plate 33 and the foot plate 34, the front sensor 59 detects the presence of the pin 58 and sends a signal to the control device 61, causing the control device 61 to stop the power drive 56 for a predetermined length of time and then to turn the power drive 56 in moving the transverse rod 53 in the reversed direction. When the transverse rod 53 is moved to position B (the opening 42), the rear sensor 60 detects the presence of the pin 58 and sends a signal to the control device 61, causing the control device 61 to stop the power drive 56 for a predetermined length of time and then to turn the power drive 56 in moving the transverse rod 53 backwards. Therefore, the transverse rod 53 is reciprocated along the bed plate 30 between the air permeable mattress 87 and the sheet-like bearing element 12 to massage the back of the sick person.

Referring to FIGS. 15 and 16, a pin 62 is mounted on the bottom side of the head plate 31. A safety control switch 63 is mounted in the bedstead 1 adjacent to the pin 62. When the bed plate 30 is moved to the horizontal position, the pin 62 is pressed on the safety control switch 63, and power supply is connected to the power drive 56. When the bed plate 30 is moved to help the sick person sit up, the pin 62 is released from the safety control switch 63, causing it to cut off power supply from the motor drive 56.

Figure 17:
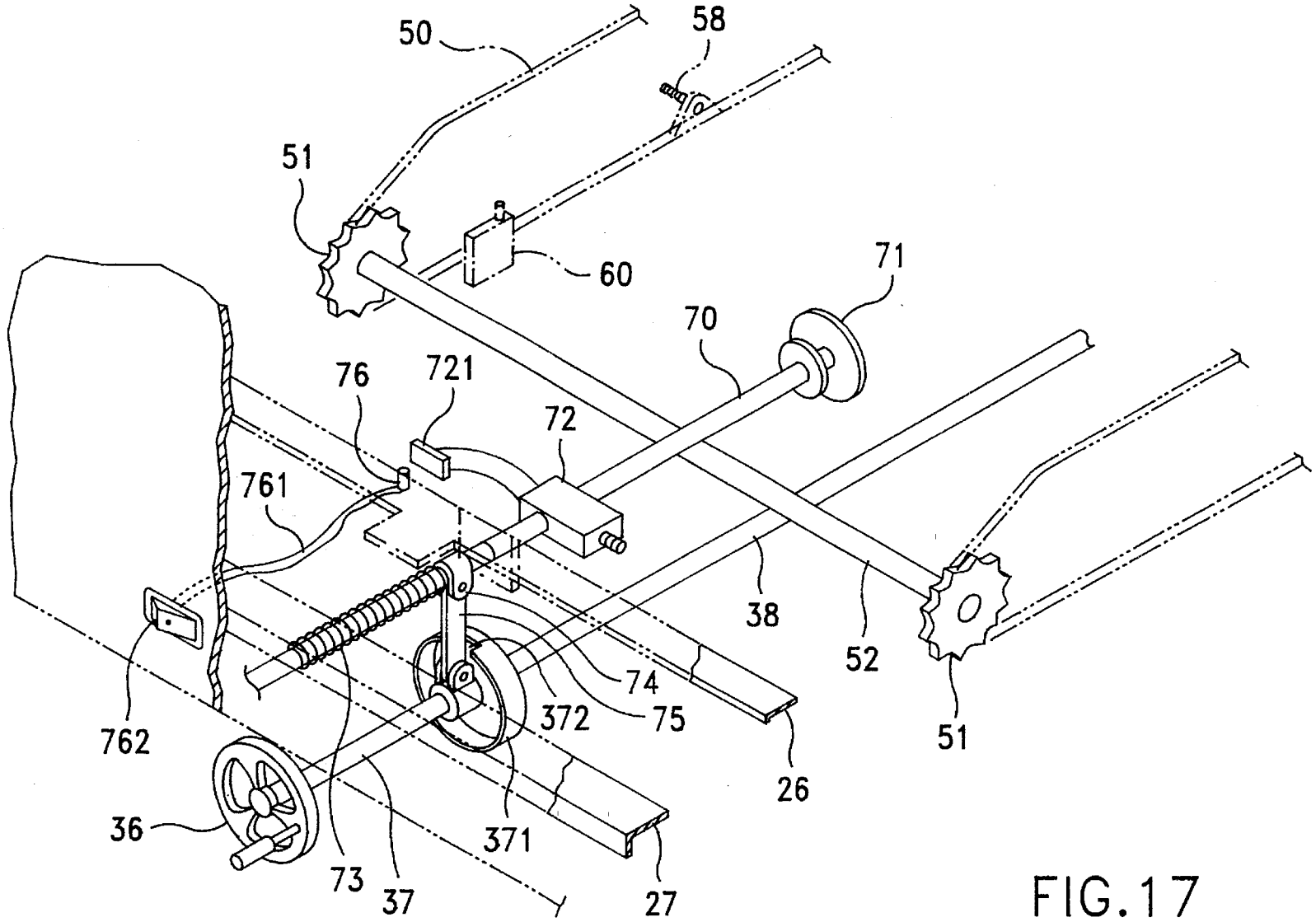
FIG. 17 is a perspective view showing the relationship between the massaging mechanism and the sit-up mechanism (when the sit-up mechanism looked and the massaging mechanism unlocked)
Figure 18:
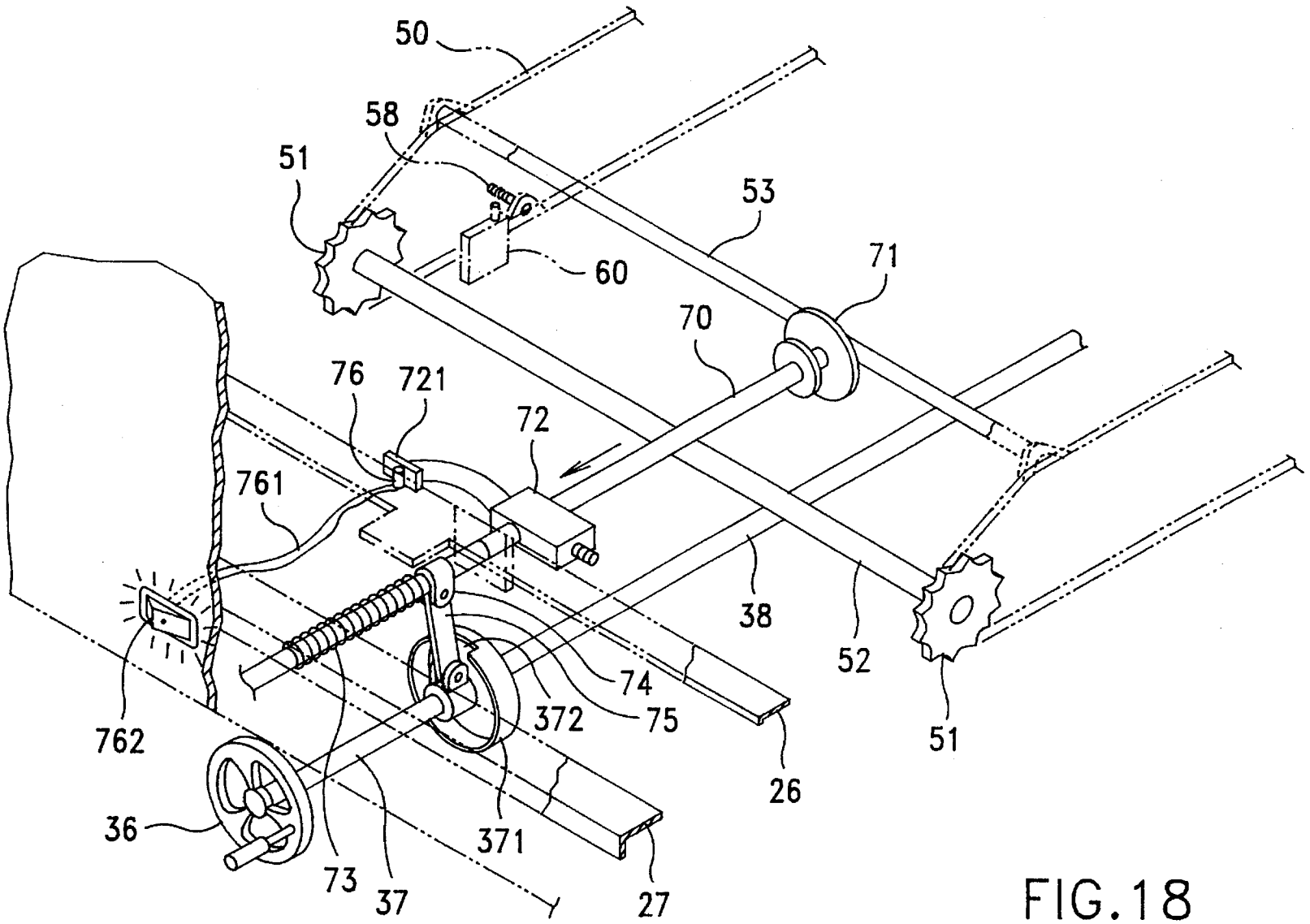
FIG. 18 is similar to FIG. 17 but showing the massaging mechanism locked, and the the sit-up mechanism unlocked.

Referring to FIGS. 17 and 18, the sit-up mechanism can be operated only when the transverse rod 53 is moved to the position A between the bottom plate 33 and the foot plate 34. A driven rod 70 is mounted at the bottom side of the foot plate 34 and inserted through a hole (not shown) on a first transverse board 26 and a hole (not shown) on a second transverse board 27. A pressure bar 72 is coupled to the middle part of the driven rod 70. A contact disk 71 is mounted at the front end of the driven rod 70. A spring 73 is mounted around the driven rod 70 between the first transverse board 26 and the second transverse board 27. The driven rod 70 is connected to a movable plate 75 at one end of the aforesaid driving rod 37 by a connector 74. The driving rod 37 is mounted with a disk 371, which has a notch 372, which engages with the movable plate 75. A switch 76 is mounted on an end block 721 at one end of the pressure bar 72 and connected to a lamp 762 through a cable 761. Referring to FIGS. 15 and 18, when the transverse rod 53 is moved to the position A, the contact disk 71 is forced backwards by the transverse rod 53, causing the end block 721 of the pressure bar 72 to touch the switch 76. When the switch 76 is touched, it is turned on to connect power supply to the lamp 762, causing the lamp 762 to give off light. When the lamp 762 is turned on, it indexes the location of the transverse rod 53 at the position A. At the same time, the movable plate 75 is moved away from the notch 372 of the disk 371 by the connector 74, permitting the driving rod 37 to be rotated to lift the bed plate 30. If the transverse rod 53 is not moved to the position A, the spring 73 forces the driven rod 70 forwards toward the head of the bedstead 1, causing the movable plate 75 to engage the notch 372 of the disk 371. When the movable plate 75 engages the notch 372 of the disk 371, the driving rod 37 is prohibited from rotary motion. Referring to FIG. 13 again, when the massaging mechanism is operated, the bed plate 30 must move to the horizontal position. Then, the turning-over mechanism is workable, when the transverse rod 53 is moving.

It is to be understood that the drawings are designed for purposes of illustration only, and are not intended as a definition of the limits and scope of the invention disclosed.

We claim:

1. A multipurpose sickbed comprising a body turning-over mechanism controlled to turn over a sick person's body, a sit-up mechanism controlled to help the sick person sit up, and a massaging mechanism controlled to massage the sick person's back, wherein:

said body turning-over mechanism comprises a bedstead (1), a left revolving shaft (11), a right revolving shaft (13), a sheet-like bearing element (12), a left guide plate (83), a right guide plate (84), a reversible motor (14), a programmable controller (17), three timers (171), (172), and (173), and a detecting chain wheel (18), said left revolving shaft (11) and right revolving shaft (13) being longitudinally mounted on two opposite sides of said bedstead (1) and respectively mounted with a left chain wheel (111) and a right chain wheel (131), said sheet-like bearing element (12) having two opposite ends respectively connected to said left revolving shaft (11) and said right revolving shaft (13), said left guide plate (83) and said fight guide plate (84) being longitudinally mounted on said bedstead (1) at two opposite sides, said reversible motor (14) being mounted on said bedstead (1), having an output shaft (141) mounted with a first chain wheel (142), a second chain wheel (143), and a third chain wheel (144), said second chain wheel (143) and said third chain wheel (144) being respectively coupled to said left chain wheel (111) and said fight chain wheel (131) by a left chain (15) and a right chain (16), said programmable controller (17) and said three timers (171), (172), and (173) being mounted on said bedstead (1), said detecting chain wheel (18) being coupled to said first chain wheel (142) by a coupling chain (181) and fixedly mounted with a pin (20), three sensors (21), (22), and (23) being spaced in path of said pin (20) of said detecting chain wheel (18) and connected to said programmable controller (17) to detect a position of said pin (20) of said detecting chain wheel (18);

said sit-up mechanism comprises a bed plate (30), a hand wheel (36), a driving rod (37), and a driven rod (38), said bed plate (30) comprised of a head plate (31), a back plate (32), a bottom plate (33), and a foot plate (34), said head plate (31) and said back plate (32) being fixedly and longitudinally connected together, said bottom plate (33) and said back plate (32) being respectively turned about a pivot (35), said foot plate (34) being fixedly mounted on said bedstead (1), said hand wheel (36) being mounted on outside of said bedstead (1) and having a handle (361) for turning by hand, said driving rod (37) having one end fixedly connected to center of said hand wheel (36) and an opposite end connected to one end of said driven rod (38) by a screw joint, said driven rod (38) having an opposite end perpendicularly connected to a coupling rod (39), said coupling rod (39) having two opposite ends connected between two parallel rods (321), which extend from said back plate (32) adjacent to said pivot (35);

said massaging mechanism comprising two transmission chains (50), a transverse rod (53), a power drive (56), a control device (61), a front sensor (59), a rear sensor (60), a safety control switch (63), a driven rod (70), a contact disk (71), a pressure bar (72), a movable plate (75), a first transverse board (26), and a second transverse board (27), said transmission chains (50) being longitudinally mounted on said bedstead (1) at two opposite sides and turned by two pairs of transmission chain wheels (51), which are coupled to a transmission shaft (52), said transverse rod (53) having two connectors (531) at two opposite ends respectively connected to said transmission chains (50) and reciprocated by said transmission chains (50) between said back plate (32) and said bottom plate (33) to massage said sick person's back, said power drive (56) being mounted on said bedstead (1) at a bottom side and controlled to turn said transmission shaft (52) through a driving chain (55), said front sensor (59) and said rear sensor (60) being disposed below said transmission chain (50) and connected to said control device (61) to detect the movement of a pin (58) on said transmission chain (50), said safety control switch (63) being mounted on said bedstead (1) and depressed by a pin (62) of said head plate (31), said driven rod (70) being inserted through a hole on said first transverse board (26) and a hole on said second transverse board (27) and mounted with a spring (73), which is stopped between said first transverse board (26) and said second transverse board (27), said contact disk (71) being connected to one end of said driven rod (70), said pressure bar (72) being coupled to a middle part of said driven rod (70) and having an end block (721) and a switch (76) on said end block (721), said movable plate (75) having one end pivotably connected to one end of said driven rod (70) by a connector (74) and an opposite end pivoted to the driving rod (37) of said sit-up mechanism, said movable plate (75) detachably engaging a notch (372) on a disk (371), which is fixedly mounted around the driving rod (37) of said sit-up mechanism.

2. The multipurpose sickbed of claim 1 wherein said left chain (15) and said right chain (16) are respectively mounted with a left micro-switch (24) and a right micro-switch (25), which will be triggered to stop said reversible motor (14) when said left revolving shaft (11) or said right revolving shaft (13) is excessively turned over a predetermined angle.

3. The multipurpose sickbed of claim 1 wherein said sheet-like bearing element (12) is connected to said left revolving shaft (11) and said right revolving shaft (13) by loop and hook materials.

4. The multipurpose sickbed of claim 1 wherein said massaging mechanism further comprises a tension adjustment chain wheel (64) engaged with said transmission chain (50) to adjust its tension.

5. The multipurpose sickbed of claim 1 wherein said body turning-over mechanism further comprises a first sensor (21), a second sensor (22), and a third sensor (23) spaced in the path of the pin (20) of said detecting chain wheel (18) and connected to said programmable controller (17) to detect the position of the pin (20) of said detecting chain wheel (18).

* * * * *